US007680253B2

(12) United States Patent
Kessler et al.

(10) Patent No.: US 7,680,253 B2
(45) Date of Patent: Mar. 16, 2010

(54) METHOD AND APPARATUS FOR REMOTE NOTIFICATION OF OFFICE MAIL DELIVERY

(75) Inventors: Jonathan C. Kessler, Boulder Creek, CA (US); Krishna I. Sankar, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 1000 days.

(21) Appl. No.: 11/118,693

(22) Filed: Apr. 29, 2005

(65) Prior Publication Data

US 2006/0245554 A1 Nov. 2, 2006

(51) Int. Cl.
*H04M 1/64* (2006.01)

(52) U.S. Cl. ..... 379/88.12; 455/412.2; 705/1; 709/217; 725/116

(58) Field of Classification Search ..... 379/88.12, 379/88.11, 88.25; 705/408, 402, 404, 1; 709/206, 229, 217; 232/24; 455/413, 412.2; 209/584; 235/375; 340/539.1, 569; 700/221, 700/223; 702/181; 725/116
See application file for complete search history.

(56) References Cited

U.S. PATENT DOCUMENTS

| | | | | |
|---|---|---|---|---|
| 4,872,210 | A * | 10/1989 | Benages | 340/569 |
| 5,036,310 | A * | 7/1991 | Russell | 340/569 |
| 5,239,305 | A * | 8/1993 | Murphy et al. | 340/539.1 |
| 5,944,786 | A * | 8/1999 | Quinn | 709/206 |
| 6,003,761 | A * | 12/1999 | Chapman | 232/24 |
| 6,029,195 | A * | 2/2000 | Herz | 725/116 |
| 6,114,959 | A * | 9/2000 | Bennett | 340/569 |
| 6,462,659 | B1 * | 10/2002 | Schuette | 340/569 |
| 6,487,599 | B1 * | 11/2002 | Smith et al. | 709/229 |
| 7,085,746 | B2 * | 8/2006 | Cordery et al. | 705/408 |
| 7,209,905 | B2 * | 4/2007 | Obrea et al. | 705/402 |
| 7,478,140 | B2 * | 1/2009 | King et al. | 709/217 |
| 2003/0105729 | A1 * | 6/2003 | Waxler | 705/404 |
| 2003/0134620 | A1 * | 7/2003 | Dutta et al. | 455/413 |

(Continued)

FOREIGN PATENT DOCUMENTS

WO 02/21383 A1 3/2002

OTHER PUBLICATIONS

Bas Monerris et al. "Pushing the Envelope, Electronic Notifications Delivery" (May 15, 2004), The Postal Project vol. 1, http:///www.postalproject.com/documents.asp?d_ID=2473, printed Dec. 1, 2008.

*Primary Examiner*—Gerlad Gauthier
(74) *Attorney, Agent, or Firm*—Weaver Austin Villeneuve & Sampson LLP

(57) ABSTRACT

A mailbox system that notifies the mail recipient, via a communication network, of the presence of physical mail in his or her mailbox. A button is placed in each mail slot that causes an electronic notification message to be sent to the mail recipient, thus notifying the mail recipient of the presence of physical mail in his or her mail slot and also causes an LED to be illuminated. When the physical mail is retrieved from the mail slot, the button is pressed again to deactivate the LED. Individual pieces of physical mail can be tagged with a RFID tag. A sensor in the mail slot reads the RFID tag and causes an electronic notification to be sent to the mail recipient.

18 Claims, 1 Drawing Sheet

U.S. PATENT DOCUMENTS

2003/0182154 A1* 9/2003 Myers et al. ..... 705/1
2003/0182155 A1* 9/2003 Nitzan et al. ..... 705/1
2005/0100143 A1* 5/2005 Bedingfield, Sr. ..... 379/88.12
2005/0216118 A1* 9/2005 Conard et al. ..... 700/223
2005/0274788 A1* 12/2005 Craig ..... 235/375
2005/0278142 A1* 12/2005 Beckert et al. ..... 702/181
2006/0079992 A1* 4/2006 Pintsov et al. ..... 700/221
2006/0108266 A1* 5/2006 Bowers et al. ..... 209/584

* cited by examiner

METHOD AND APPARATUS FOR REMOTE NOTIFICATION OF OFFICE MAIL DELIVERY

FIELD

The present invention relates broadly to communication networks and mail delivery. Specifically, the present invention relates to a physical mailbox system that provides electronic notification to a remote user that the user has physical mail in his or her mailbox.

BACKGROUND

In today's largely paperless office environment, the physical mail room has become an afterthought for many employees. Whereas in the past, much business-critical communication to an employee's physical mailbox, today's communication is largely reliant upon email and other electronic forms of communication delivered over a communication network. This paperless communication has also enabled many employees to work from locations, such as their home, as computer networks reduce the need for these employees to always be onsite during business hours. Consequently, many employees rarely check the physical mailboxes at their workplace, sometimes missing important and time-sensitive business communications.

SUMMARY

The present invention solves the problem described above by providing a mailbox system that notifies the mail recipient of the presence of physical mail in his or her mailbox. The mailbox system is assigned at least one IP address on the network, and in some cases an IP address for each individual mail slot in the mailbox system. In an embodiment, the each mail slot has a button and LED indicator. When the person delivering physical mail places a piece of mail in a mail slot, he or she presses the button that causes an electronic notification message to be sent to the mail recipient, thus notifying the mail recipient of the presence of physical mail in his or her mail slot. Also, in an embodiment, pressing the button also causes the LED to be illuminated. When the physical mail is retrieved from the mail slot, the button is pressed again to deactivate the LED. In an embodiment, pressing this button can also generate an electronic message that is sent to the mail administrator indicating that mail was retrieved. Alternatively, separate buttons can be used for the mail administrator and the recipient.

In another embodiment, individual pieces of physical mail can be tagged with a radio frequency identification (RFID) tag that uniquely identifies the piece of mail to which it is affixed, and also can be associated information related to the physical piece of mail that is stored on the mailbox system server, such as a scanned image of the mail. In this embodiment, a sensor is placed in the mail slot, which automatically senses the presence of mail by proximity when a piece of mail is placed in the mail slot. In an embodiment, the sensor reads the RFID tag and causes an electronic notification to be sent to the mail recipient. In an embodiment, the mail recipient can access the mail server and obtain information associated with the RFID tag for each piece of mail. In this manner, the mail recipient can determine the importance of the mail in his or her respective mail slot, and then decide when to actually retrieve the delivered mail. Similarly, the mailbox system server can also maintain a database of delivery time, the time a notification message was sent to the mail recipient, the time the mail recipient checked his mail to determine its relative importance, as well as the time the mail recipient actually picked up his or her mail.

Many other features and advantages of the present invention will become apparent through reading the following detailed description, when considered in conjunction with the drawings.

DETAILED DESCRIPTION

Figure 1:
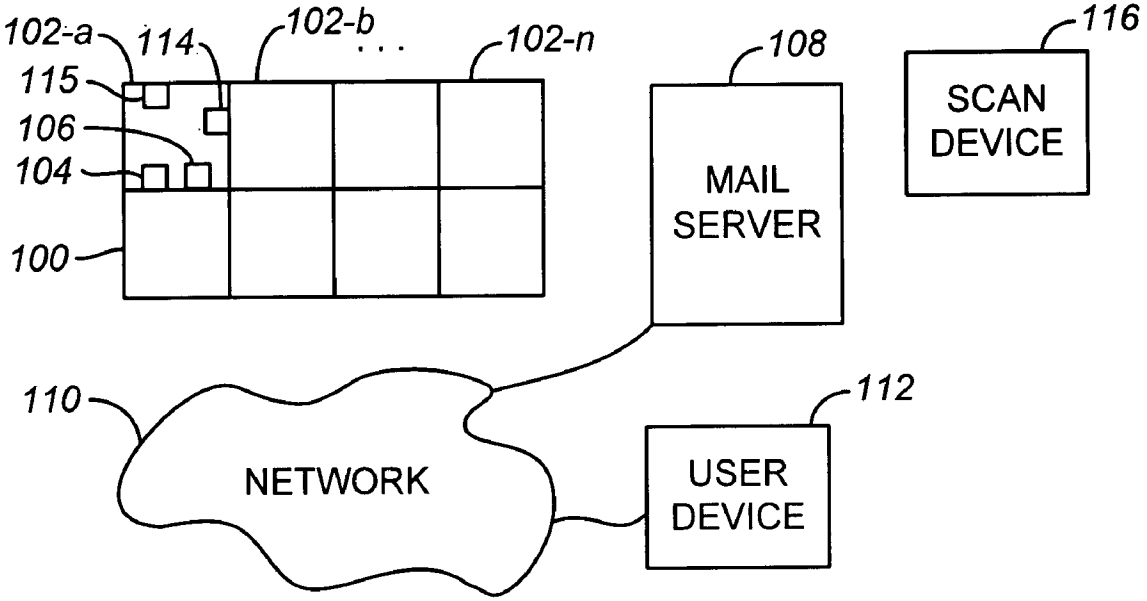
FIG. 1 illustrates in block diagram form the major components used in embodiments of the present invention.

Directing attention to FIG. 1, mailbox 100 contains a plurality of individual mail slots 102-*a*, 102-*b*, . . . 102-*n*, where n is the desired number of mail slots, and individual mail slots are reserved for individual mail recipients. Envelopes and/or packages can be delivered to mailbox 100, and are collectively referred to herein as mail. In an embodiment, each mail slot 102 utilizes button 104 and LED 106, both of which are connected to mail server 108. When mail is placed in mail slot 102, the mail administrator presses button 104, which causes LED 104 to be illuminated in an embodiment, and also causes mail server 108 to generate an electronic notification message and send it over network 110 to the mail recipient—the user assigned to mail slot 102. The electronic message is received by mail recipient's user device 112, which informs the mail recipient of the presence of mail in his or her mail slot 102. The electronic message can be implemented as a traditional email message addressed to the mail recipient's email account, and network 110 is a computer network such as a local area network, wide area network, or larger computer network such as the Internet. User device 112 can be a personal computer, either a traditional desktop or laptop computer, or also on portable wireless computer devices, such as a Palm Pilot, Blackberry, or the like. In another embodiment, user device 112 can be a cell phone, pager, or other telephony device, and network 110 is a communication network such as a public telephone network. In this embodiment, the electronic message generated can also be in the form of a text message, or in an audible voicemail message.

Once the mail recipient receives the mail notification message, he or she can visit the location of mailbox system 100 and retrieve his or her mail. Upon retrieving the mail from mail slot 102, the mail recipient presses button 104, which deactivates LED 106 in an embodiment and notifies mail server 108 that mail has been retrieved from mail slot 102.

In another embodiment, mail slot 102 utilizes sensor 114, which detects the presence of a piece of mail having an RFID tag affixed to it. Additionally, proximity sensor 115 can be included, which senses whether mail with an RFID tag is placed in mail slot 102. In the preferred embodiment, all mail slots 102 communicate with mail server 108 via a wireless network. In this embodiment, there are several ways of notifying the mail recipient. In one embodiment, as mail is delivered to mail system 100, a mail administrator affixes the RFID tag to the piece of mail and places it in mail slot 102. Sensor 114 receives a signal from the RFID tag having sufficient strength to indicate that the piece of mail is in mail slot 102, and not a neighboring slot. To ensure that signals from RFID tags do not bleed over from neighboring mail slots, mailbox 100 can be constructed of insulated material that limits the amount of RF that passes through the material. Upon sensing a piece of mail bearing the RFID tag in mail slot 102, sensor 114 causes mail server to send the mail notification message as described above. In an embodiment, sensor 114 can also detect when the mail is removed by determining that no RFID signal is present in mail slot 102. In this embodiment, sensor 114 can indicate to mail server 108 that mail has been retrieved. By using RFID tags and sensor 114, there is no need to utilize button 102 and LED 104, as mail server 108 can track the issuance of mail notification messages as well as when mail was retrieved from mail slot 102.

Additionally, metadata information describing the mail, such as the origin of the mail, the addressed recipient, postmark, date received, contents, purchase order number, customs forms, delivery company, weight, or other useful information can be stored within RFID tag and read by sensor 114. Alternatively, this information can simply be stored on mail server 108. In either case, this information can also be sent to the user in the electronic notification message described above.

In an embodiment, as the mail administrator tags individual pieces of mail, the mail administrator can also use scanning device 116 to capture an electronic image of the mail piece, and store it in electronic form such as represented by a JPEG file or other image file format. Each scanned image can be associated with an individual mail slot 102, and stored in mail server 108. Depending on the embodiment of the present invention, the scanned image can be automatically sent to the mail recipient in a similar manner as the mail notification message described above, or simply stored on mail server 108 and accessed via mail server 108's connection to network 110 as desired by the mail recipient.

Figure 2:
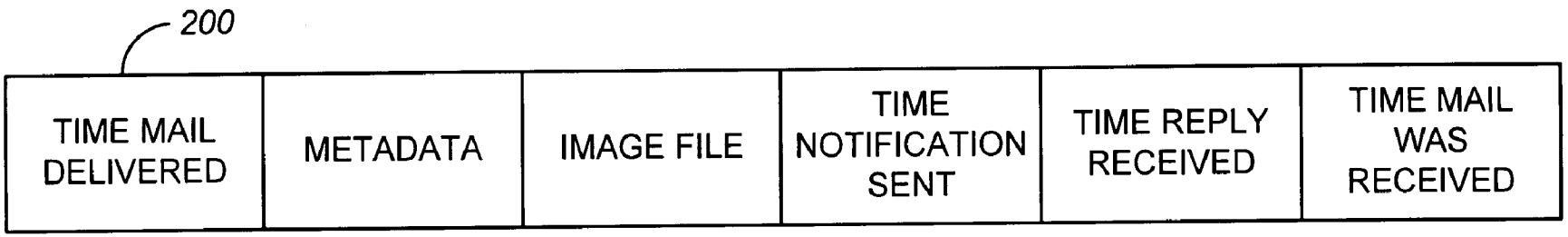
FIG. 2 illustrates the organization of a database maintained by a mailbox system server in accordance with an embodiment of the present invention.

Mail server 108 maintains a database having multiple records for each piece of mail delivered to the individual mail slots 102. FIG. 2 illustrates an exemplary organization of an individual record 200 maintained by this database. For each piece of mail delivered, record 200 can be stored in mail server 108 and updated as necessary to include information such as mail slot number, what time the mail was delivered to mail slot 102, the mail's metadata as described above, an image file of the mail piece, what time the electronic notification was sent to the mail recipient, the time a reply from the mail recipient was received by mail server 108, and what time the mail was retrieved from mail slot 102. All or part of record 200 can be included in the electronic message delivered to the mail recipient, and all or part of this record can be viewed by the mail recipient when he or she connects to mail server 108 via network 110.

While a method and apparatus for remote notification of office mail delivery has been described and illustrated in detail, it is to be understood that many modifications can be made to the various embodiments of the present invention without departing from the spirit thereof.

What is claimed is:

1. A mailbox system for automatically providing remote notification of physical mail delivery, the system comprising:

a mailbox containing a plurality of physical mail slots, each mail slot in the plurality assigned to a mail recipient;

a radio frequency identification (RFID) tag sensor configured to detect a radio frequency identification tag attached to physical mail placed in each of the mail slots, said RFID tag uniquely identifying the physical mail, wherein the RFID tag further contains information describing contents of the physical mail; and a notification device, the notification device receiving a signal from the detection device when physical mail is delivered to a physical mail slot, the notification device automatically notifying the mail recipient associated with that physical mail slot when the notification device receives said signal.

2. The mailbox system of claim 1, wherein the notification device comprises a mail server configured to send an electronic message notifying the mail recipient when physical mail is delivered.

3. The mailbox system of claim 1, further comprising a proximity sensor configured to detect the presence of physical mail placed in the mail slot.

4. The mailbox system of claim 2, further comprising an input device configured to communicate with the mail server, the input device capable of sending data to the mail server, the data describing a piece of physical mail placed within a mail slot.

5. The mailbox system of claim 4, wherein the input device comprises a scanner that captures an electronic image of the piece of mail.

6. The mailbox system of claim 2, wherein the mail server maintains a database, the database containing data associated with pieces of physical mail.

7. The mailbox system of claim 6, wherein contents of the database are accessible by remotely located mail recipients.

8. The system of claim 1, wherein the detection device automatically detects the removal of physical mail from the recipient's mail slot and signals the notification device, and wherein the notification device automatically notifies a mail administrator that the physical mail has been removed from the mail slot.

9. The mailbox system of claim 6, wherein the data associated with a piece of physical mail comprises one or more of a postmark, a purchase order number, customs forms, or a delivery company.

10. The mailbox system of claim 6, wherein the data associated with a piece of physical mail comprises one or more of an origin of the mail, a recipient, a date received, or a weight.

11. The mailbox system of claim 6, wherein the data associated with a piece of physical mail comprises one or more of a delivery time, a notification time, a time the mail was checked, or a time the mail was picked up.

12. A method of automatically providing remote notification of physical mail delivery to a mail recipient, the method comprising:

automatically detecting when physical mail has been delivered to a physical mail slot associated with a mail recipient, wherein each piece of physical mail is uniquely identified;

generating a notification message when the delivery of physical mail is detected, the notification message informing a mail recipient of the presence of the uniquely identified physical mail delivered to the mail slot associated with the mail recipient, the notification message further comprising an electronic image of the physical mail captured by a scanning device; and sending the notification message to the mail recipient over a communication network.

13. The method of claim 12, wherein the automatically detecting comprises reading a radio frequency identification tag attached to a piece of physical mail placed within the mail slot.

14. The method of claim 12, wherein the automatically detecting further comprises a proximity sensor detecting physical mail placed within the mail slot.

15. The method of claim 12, wherein a mail server maintains a database containing data associated with each piece of physical mail, the method further comprising updating the database with data associated with each piece of physical mail.

16. The method of claim 15, further comprising providing access to the data associated with each piece of physical mail to remotely located mail recipients via the communication network.

17. The method of claim 12, further comprising:

automatically detecting the removal of physical mail from the recipient's mail slot;

automatically signaling the notification device; and automatically notifying a mail administrator that the physical mail has been removed from the mail slot.

18. An apparatus for automatically providing remote notification of the delivery of physical mail to a physical mail slot, comprising:

a processor; and a memory, at least one of the processor or the memory being configured to:

receive a signal from a radio frequency identification (RFID) tag sensor connected to the physical mail slot, said detection device sending said signal on the delivery of physical mail with an attached RFID tag to a recipient's mail slot, said signal uniquely identifying each piece of physical mail and containing information describing the physical mail, the information comprising at least one of an origin of the mail or a delivery time; and send a notification message to the recipient when said signal is received.

* * * * *